United States Patent [19]

Atkins, Sr.

[11] Patent Number: 4,718,585

[45] Date of Patent: Jan. 12, 1988

[54] ANTI-SLIP HOLSTER AND METHOD OF USING THE SAME

[75] Inventor: John H. Atkins, Sr., Cincinnati, Ohio

[73] Assignee: A & B Industries, Inc., Cincinnati, Ohio

[21] Appl. No.: 918,570

[22] Filed: Oct. 15, 1986

[51] Int. Cl.[4] ..... F41C 33/02

[52] U.S. Cl. ..... 224/238; 224/911

[58] Field of Search ..... 224/192, 238, 240, 243, 224/253, 911, 901, 912

[56] References Cited

U.S. PATENT DOCUMENTS

| | | | |
|---|---|---|---|
| 2,049,293 | 7/1936 | Fink | 224/911 X |
| 2,213,472 | 9/1940 | Myres | 224/243 |
| 3,731,858 | 5/1973 | Baker | 224/911 X |
| 3,942,692 | 3/1976 | Chica | 224/911 X |
| 4,062,481 | 12/1977 | Clark | 224/911 X |
| 4,303,187 | 12/1981 | Berman | 224/240 X |
| 4,424,924 | 1/1984 | Perkins | 224/911 X |
| 4,480,776 | 11/1984 | Atkins, Sr. | 224/911 X |
| 4,572,415 | 2/1986 | Fehr | 224/253 |
| 4,577,787 | 3/1986 | Hersey | 224/911 X |

FOREIGN PATENT DOCUMENTS

| | | | |
|---|---|---|---|
| 2527351 | 2/1976 | Fed. Rep. of Germany | 224/911 |

*Primary Examiner*—Charles E. Phillips
*Assistant Examiner*—Robert M. Petrik
*Attorney, Agent, or Firm*—Frost & Jacobs

[57] ABSTRACT

The present invention includes a holster for carrying a hand gun. The holster includes a body having a compartment for receiving a hand gun on its outer surface. A belt loop is provided on the inner surface of the body. A first tab and a second tab are joined to opposite sides of the body. The tabs include belt loops on their respective inner surfaces. The tabs are aligned on the body so that the belt loops of the first tab, second tab and body can simultaneously receive a belt. When worn, a trouser belt loop can be inserted between the first tab loop and the body loop, or between the second tab loop and the body loop, to prevent the holster from sliding with respect to a belt.

9 Claims, 5 Drawing Figures

ANTI-SLIP HOLSTER AND METHOD OF USING THE SAME

BACKGROUND OF THE INVENTION

1. Field of the Invention

The present invention relates generally to a hand gun holster, and more particularly is directed to a holster which does not slip or slide on a wearer's belt.

2. Description of the Related Art

Holsters which are carried on a wearer's belt are very well known in the art. Often, a holster includes a belt loop on an inner surface which is placed against a wearer's body. A belt is inserted in the loop to secure the holster to the wearer. U.S. Pat. No. 4,273,276 is representative of a holster having a single belt loop.

A particular problem with holsters having a single belt loop is their tendency to slip or slide with respect to the belt. Siding can occur when a wearer is walking or running. This problem is heightened when a hand gun is being withdrawn from the holster. The holster slides forward or aft on the belt as the gun is withdrawn, depending upon the motion of draw. In crucial situations, such as a draw by a law enforcement officer, a sliding holster could result in a slow and ineffective draw.

Another problem with such holsters is that they tend to sag and droop away from the wearer's body. Once a hand gun is inserted into a holster, the weight of the gun pulls the holster away from the body. Such a holster is not snug or stable against a wearer's body, particularly when walking or running. It is possible for a gun to be vibrated out of the holster as it flops back and forth. Furthermore, comfort and concealment of a handgun in such a holster is not satifactory.

U.S. Pat. No. 3,731,858 issued to Baker in 1973 shows a holster having three belt slots. The holster can be worn either on the right- or left-hand side in either the regular or cross-draw position. However, only two of the three slots are utilized at any given time. The alignment of the slots is such that all three slots are not designed to be utilized simultaneously.

Consequently, a need exists for improvements in holsters for hand guns. A hand gun holster should be secure and not slide when it is carried by a belt. In addition, it is desireable for a holster to secure a hand gun close to and snugly against a wearer's body. A holster should be comfortable and inexpensive to manufacture.

SUMMARY OF THE INVENTION

The present invention includes a holster for a hand gun which does not slide on a wearer's belt, and which rides high on and fits snugly next to a wearer's hip. The design prevents the holster from sliding as the hand gun is withdrawn. In addition, the holster and hand gun are prevented from sagging and pulling away from a wearer's body. The holster is comfortable and inexpensive to manufacture.

In a preferred embodiment, the present invention includes a holster for carrying a hand gun. The holster includes a body having a compartment for receiving a hand gun on its outer surface. A belt loop is provided on the inner surface of the body. A first tab and a second tab are joined to opposite sides of the body. The tabs include belt loops on their respective inner surfaces. The tabs are aligned on the body so that the belt loops of the first tab, second tab and body can simultaneously receive a belt. When worn, a trouser belt loop can be inserted between the first tab loop and the body loop, or between the second tab loop and the body loop, to prevent the holster from sliding with respect to a belt.

In accordance with another aspect of the invention, a patch or area of hook and loop fasteners is provided on an outer surface of at least one tab for receiving an identification badge or the like having complementary hook and loop fasteners.

The entire holster can be fabricated from nylon or similar material to create a lightweight, waterproof and durable holster. The entire holster can also be fabricated from the more traditional materials of construction, namely leather and leather-like materials.

Further features of the invention will become apparent from the following detailed description.

DETAILED DESCRIPTION OF THE PREFERRED EMBODIMENTS

Figure 1:
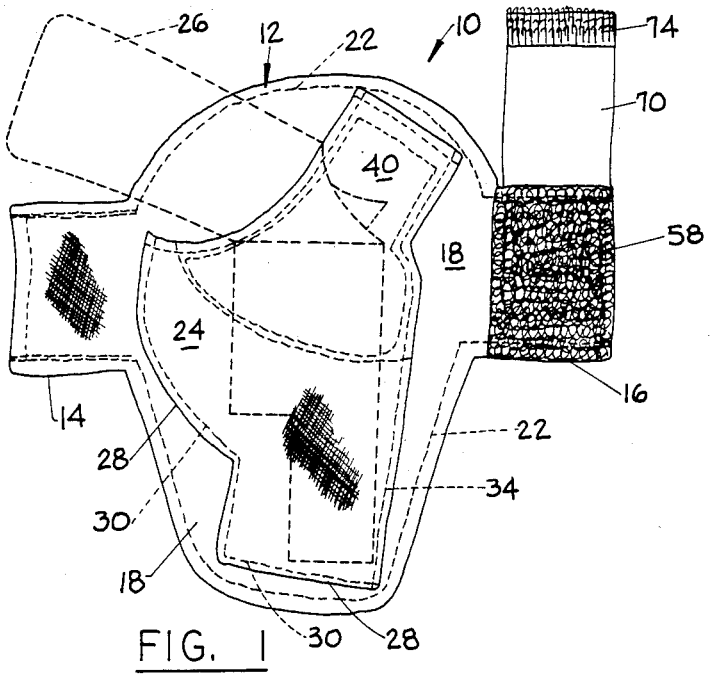
FIG. 1 is a front elevational view of the holster of the present invention with a hand gun illustrated in phantom lines inserted in the holster.
Figure 2:
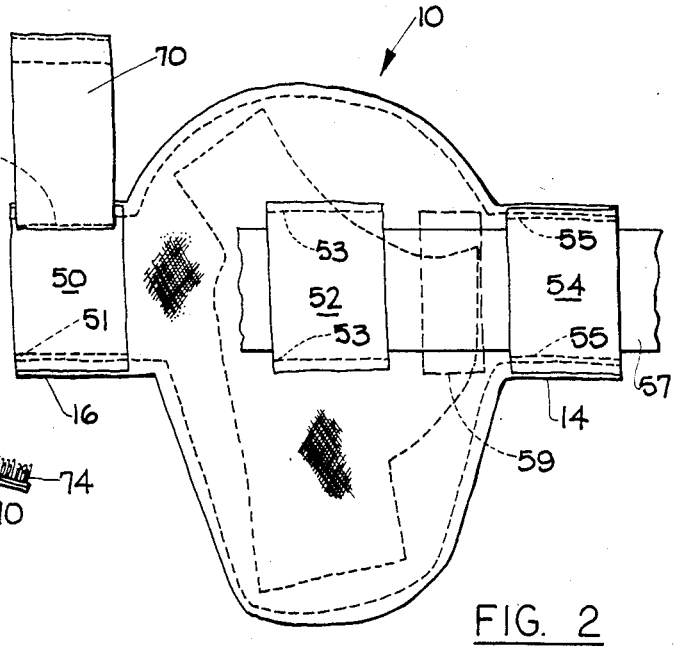
FIG. 2 is a rear elevational view of the holster of FIG. 1 with a belt and trouser belt loop illustrated in phantom lines.
Figure 3:
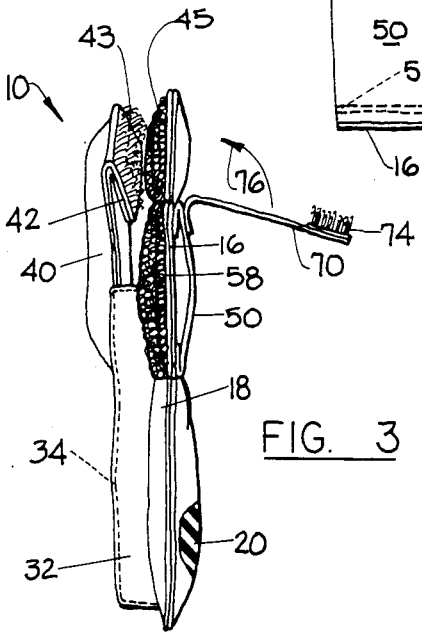
FIG. 3 is a side elevational view of the holster of FIG. 1.

A preferred embodiment of the holster of the present invention is illustrated generally at 10 in FIGS. 1–3. Holster 10 includes a central body indicated generally at 12 and a first tab 14 and a second tab 16. Tabs 14 and 16 are joined to opposite sides of the body 12.

Body 12 includes an inner panel 18 which is worn against the wearer's body. As illustrated in FIG. 3, the inner panel 18 can be provided with a suitable interior padding or cushioning material 20 such as foam rubber or the like. The outer periphery of the inner panel 18 is sealed by means of stitching or the like indicated at 22. Stitching 22 encloses the padding 20 and prevents its escape.

An outer panel 24 is shaped to cover the barrel and lower portion of a hand gun, illustrated diagrammatically at 26 in FIG. 1. Outer panel 24 is joined along its lower margin 28 to inner panel 18 by means of stitching or the like indicated by 30.

A bolster 32, illustrated only in FIG. 3, is connected to the inner panel 18 and outer panel 24. Referring to FIG. 3, the left margin of bolster 32 is joined by stitching or the like indicated at 34 to the outer panel 24. The right margin of bolster 32 is joined by stitching or the like (not shown) to the inner panel 18. Inner panel 18, outer panel 24 and bolster 32 cooperate to form a compartment for receiving hand gun 26.

The upper portion of outer panel 24 can include a thumb break for selectively securing the hand gun 26 in the holster 10. Such a thumb break is fully disclosed in my U.S. Pat. No. 4,480,776 which is hereby incorporated by reference. Generally a thumb break includes a flexible tab 40 and a latch flap 42. Latch flap 42 is provided with hook and loop fasteners 43 such as Velcro which engage mating hook and loop fasteners 45 provided on the inner panel 18. After a hand gun 26 has been inserted into the compartment, tab 40 is pressed so that the latch flap fasteners 43 engage inner panel fasteners 45 to selectively hold the hand gun 24 in place.

Tabs 14 and 16 are provided on opposite sides of body 12. As illustrated in the preferred embodiment of FIGS. 1–3, tabs 14 and 16 can be integral with the inner panel 18. On the inner surface of tab 14, inner panel 18 and tab 16, belt loops 50, 52 and 54 are provided, respectively, as illustrated in FIG. 2. Belt loop 50 is joined to tab 16 by means of stitching or the like indicated at 51. In a similar manner, stitching 53 joins loop 52 to the inner panel 18 and stitching 55 joins loop 54 to tab 16. Loops 52 and 54 are spaced a desired distance from loop 50 as described below. Belt loops 50, 52 and 54 are laterally aligned along the inner surface of the holster 10 so that each of them can receive a belt 57 simultaneously.

In use, the holster 10 can be "locked" into position on a wearer's body by inserting a trouser belt loop 59 between two of the three loops 50, 52 and 54 of the holster 10. For example, the holster 10 can be aligned in such a manner that the trouser belt loop 59 is positioned between the body belt loop 52 and first tab belt loop 54, as illustrated in FIG. 2. The belt 57 is inserted through loops 52, 59 and 54 to lock the holster 10 in a "forward" position. This alignment prevents the holster 10 from slipping or sliding on the belt 57 when the hand gun 26 is being withdrawn. The trouser belt loop 59 engages loops 52 and 54 to prevent movement of the holster 10. Preferably the trouser belt loop 59 is as wide as the space between loops 52 and 54. Alternatively, the holster 10 can be aligned in such a manner that trouser belt loop 59 is positioned between second tab loop 50 and body loop 52. Belt 57 is inserted through loops 50, 59 and 52 to lock the holster 10 in a "rearward" position.

If desired a wearer can insert his or her belt 57 through belt loops 50, 52 and 54 without locking the holster with a trouser belt loop 59 as described above. The holster 10 can slide with respect to belt 57 and be positioned as desired by a wearer. In such use, a holster 10 is prevented from flopping away from a wearer's body, permitting the holster 10 to be more easily concealed.

If desired, hook and loop fasteners 58 such as Velcro or the like can be provided on an outer surface of tab 14 or tab 16. For illustrative purposes only, fasteners 58 are shown in FIG. 1 on tab 16. Fasteners 58 can receive mating fasteners from a patch (not shown) or other member. Such a patch can hold an identification badge or other desired member. If desired, fasteners 58 can be provided on both tabs 14 and 16, or any other suitable position on the holster 10.

If desired, a protective flap 70 can be joined to loop 50 to cover a badge or other desired member carried by fasteners 58. The flap 70 is joined to loop 50 by stitching or the like indicated at 72. Flap 70 can include mating fasteners 74. After a badge or other member is secured to fasteners 58, flap 70 is folded in the direction of arrow 76. Fasteners 74 are pressed against fasteners 58 to removably secure flap 70 on tab 16 to cover a badge or other member. Of course, a flap 70 can also be provided on loop 54 as desired.

Figure 4:
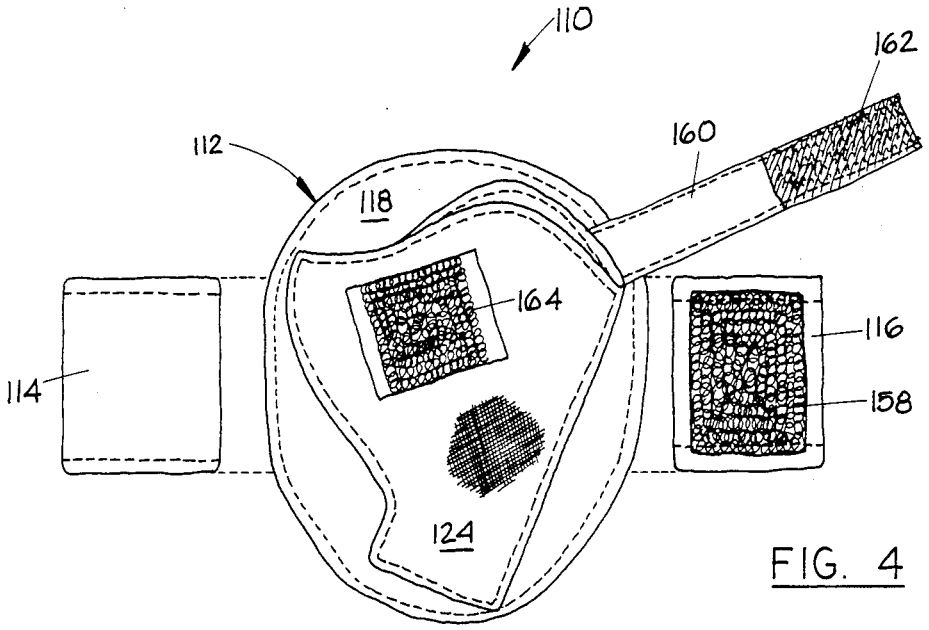
FIG. 4 is an exploded, front elevational view of an alternate embodiment of the present invention illustrating tabs which are joined to the body of the holster.
Figure 5:
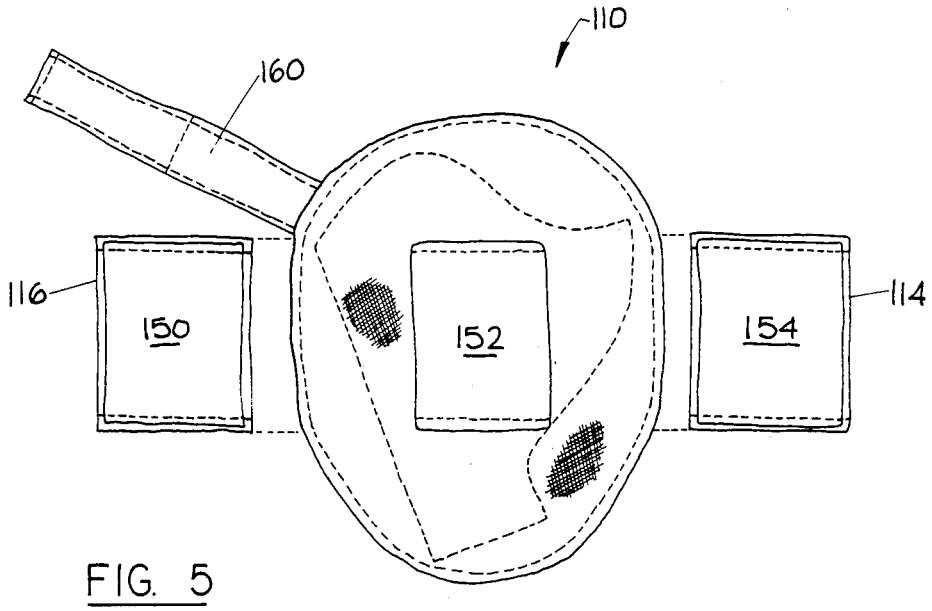
FIG. 5 is an exploded, rear elevational view of the holster of FIG. 4.

An alternate embodiment of the present holster is indicated generally at 110 in FIGS. 4 and 5. Holster 110 includes a body 112 and tabs 114 and 116.

Body 112 includes an inner panel 118 and an outer panel 124 which are joined by means of stitching or the like to form a hand gun compartment in a manner similar to that described above. A latch 160 is joined to an upper portion of the inner panel 118 and includes hook and loop fasteners 162. Complementary hook and loop fasteners 164 are provided on the outer surface of the outer panel 124. After a hand gun is inserted into the compartment, the latch 160 is folded over the gun so that fasteners 162 mate with fasteners 164 to selectively hold the gun in place.

Tabs 114 and 116 are separate members from inner panel 118. As illustrated in FIG. 5, a belt loop 150 is provided on the inner surface of tab 116. A belt loop 154 is provided on the inner surface of tab 114. Tabs 114 and 116 are joined to inner panel 118 by means of stitching or the like so that loops 150 and 154 align with belt loop 152 provided on the inner surface of inner panel 118. In use, it is preferred that a wearer insert a trouser belt loop 59 between two of loops 150, 152 and 154 so that holster 110 will not slip or slide on wearer's belt 57. Furthermore, the holster 10 will ride high on the wearer's hip and remain close to his or her body.

If desired, hook and loop fasteners 158 can be provided on either tab 114 or 116, or both, or any other suitable location on holster 110 for receiving a patch, badge, etc. having mating hook and loop fasteners. A protective flap, similar to flap 70, can also be provided to cover a badge, etc. secured on fasteners 158.

Other embodiments of the present invention are easily envisioned. For example, tabs 114 and 116 can be attached to a conventional holster having any number of belt loops provided on its inner surface. Tabs 114 and 116 are joined to the outer margin so that they are utilized simultaneously with one or more belt loops of the holster. If two or more of such belt loops are aligned to be simultaneously utilized, tabs 114 and 116, having respective belt loops 154 and 150, are laterally aligned to be utilized with the existing belt loops.

In another example, tabs 114 and 116 can be attached to a holster which does not have a belt loop. By joining tabs 114 and 116 to opposite sides of such a holster, the holster can be worn on a wearer's body.

In yet another example, a single tab 114 or 116 can be attached to either side on a holster body 112. A trouser belt loop 59 can be positioned between the tab belt loop 150 or 154 and the body belt loop 152 to prevent the holster 110 from sliding with respect to the belt 57.

For purposes of an exemplary showing, holsters 10 and 110 can be fabricated entirely from lightweight, durable nylon material. Such material is easiy cut to form the component parts of the holster. The component parts may then be easily sewn together to complete the holster construction. As noted hereinabove, padding may be provided for the comfort of the wearer. In addition, the relatively slick surface of the nylon material facilitates the withdrawal of the hand gun 26 from the holster 10 and 110. Furthermore, the entire holster 10 and 110 is relatively lightweight and water resistant, thereby serving to protect the hand gun.

Although the present invention has been described with reference to preferred embodiments, workers skilled in the art will recognize that changes may be made in form and detail without departing from the spirit and scope of the invention.

What is claimed is:

1. A holster for holding a hand gun, comprising:

(a) a body having (i) an inner panel placed adjacent a wearer's body, the inner panel having inner and outer surfaces, wherein the inner surface is placed adjacent a wearer's body;

(ii) an outer panel joined along its lower margins to the inner panel outer surface; and (iii) a bolster, joined along a first margin to the inner panel and joined along a second margin to the outer panel, wherein the inner panel, outer panel and bolster cooperate to form a compartment for receiving a hand gun;

(b) belt receiving means associated with the inner surface of the inner panel;

(c) a first tab joined to a first side of the inner panel, the first tab having an inner surface placed adjacent a wearer's body, the first tab inner surface including a belt receiving means;

(d) a second tab joined to an opposite side of the inner panel, the second tab having an inner surface placed adjacent a wearer's body, the second tab inner surface including a belt receiving means, wherein the belt receiving means of the first tab, second tab and inner panel are aligned for simultaneously receiving a belt.

2. The holster as specified in claim 1 wherein the inner panel, first tab and second tab are of unitary construction.

3. The holster as specified in claim 1 and including means for selectively securing a hand gun in the gun compartment.

4. The holster as specified in claim 1 and including fastening means associated with an outer surface of at least one of said tabs for receiving a selected member having complimentary fastening means.

5. The holster as specified in claim 4 and including a protective flap joined to the inner surface of said tab for covering said selected member.

6. The holster as specified in claim 1 wherein the body and tabs comprise leather.

7. The holster as specified in claim 1 wherein the body and tabs comprise leather-like materials.

8. The holster as specified in claim 1 wherein the body and tabs comprise a fabric material.

9. The holster as specified in claim 1 wherein the body and tabs comprise nylon material.

* * * * *